US007456853B1

(12) United States Patent
Bucklen

(10) Patent No.: US 7,456,853 B1
(45) Date of Patent: Nov. 25, 2008

(54) ANALOG INTERFACE STRUCTURES AND METHODS THAT REDUCE DISPLAY ARTIFACTS IN DIGITAL DISPLAYS

(75) Inventor: Willard Kraig Bucklen, Greensboro, NC (US)

(73) Assignee: Analog Devices, Inc., Norwood, MA (US)

( * ) Notice: Subject to any disclaimer, the term of this patent is extended or adjusted under 35 U.S.C. 154(b) by 731 days.

(21) Appl. No.: 10/971,839

(22) Filed: Oct. 22, 2004

(51) Int. Cl.
*G09G 5/02* (2006.01)

(52) U.S. Cl. ..... 345/693; 345/694; 345/696; 348/446

(58) Field of Classification Search ..... 345/605, 345/540, 213, 691, 692, 693, 694, 696; 348/446, 348/458

See application file for complete search history.

(56) References Cited

U.S. PATENT DOCUMENTS 5,097,257 A * 3/1992 Clough et al. ..... 345/546
5,469,190 A * 11/1995 Masterson ..... 345/605
5,488,389 A * 1/1996 Nakanishi et al. ..... 345/540
6,052,491 A * 4/2000 Clatanoff et al. ..... 348/E5.062
6,078,317 A 6/2000 Sawada ..... 345/204
6,118,905 A 9/2000 Uehara et al. ..... 382/252
6,215,913 B1 4/2001 Clatanoff et al. ..... 382/275
6,456,340 B1 9/2002 Margulis ..... 348/745
6,803,893 B1 * 10/2004 Hwang ..... 345/213

OTHER PUBLICATIONS

Metaxas, Panagiotis, "Optimal Parallel Error-Diffusion Dithering", Proceedings of SPIE, vol. 3648, Dec. 1998, pp. 485-494.
Ostromoukhov, Victor, "A Simple and Efficient Error-Diffusion Algorithm", Proceedings of SIGGRAPH 2001, Computer Graphics Annual Conference Series, Aug. 2001, pp. 567-572.
Shaked, Doron, "Color Diffusion: Error-Diffusion for Color Halftones", HP Labs Isreal, Technion City, Isreal, May 1999, pp 1-10.

* cited by examiner

*Primary Examiner*—Kevin M Nguyen
(74) *Attorney, Agent, or Firm*—Koppel, Patrick, Heybl & Dawson

(57) ABSTRACT

Display structures and methods are provided that introduce redundancy and use this redundancy with different mapping rules on different interleaved display lines to visually diffuse display artifacts. The artifacts are typically produced by errors in the transmission and recovery of analog display signals that subsequently drive digital displays. This visual diffusion substantially reduces the display artifacts and, because these visual improvements require only one element (an ADC) in the display system to be configured at a higher resolution, the visual advantageous are realized with relatively low cost.

24 Claims, 7 Drawing Sheets

| INPUT | TRUNCATED | MAPPED DOWN | ROUNDED | MAPPED UP |
|---|---|---|---|---|
| 01111 | 011 | 100 | 100 | 100 |
| 01110 | 011 | 011 | 100 | 100 |
| 01101 | 011 | 011 | 011 | 100 |
| 01100 | 011 | 011 | 011 | 011 |
| 01011 | 010 | 011 | 011 | 011 |
| 01010 | 010 | 010 | 011 | 011 |
| 01001 | 010 | 010 | 010 | 011 |
| 01000 | 010 | 010 | 010 | 010 |
| 00111 | 001 | 010 | 010 | 010 |
| 00110 | 001 | 001 | 010 | 010 |
| 00101 | 001 | 001 | 001 | 010 |
| 00100 | 001 | 001 | 001 | 001 |
| 00011 | 000 | 001 | 001 | 001 |
| 00010 | 000 | 000 | 001 | 001 |
| 00001 | 000 | 000 | 000 | 001 |
| 00000 | 000 | 000 | 000 | 000 |

90

92

ANALOG INTERFACE STRUCTURES AND METHODS THAT REDUCE DISPLAY ARTIFACTS IN DIGITAL DISPLAYS

BACKGROUND OF THE INVENTION

1. Field of the Invention

The present invention relates generally to digital displays and, more particularly, to analog interfaces that reduce display artifacts in the digital displays.

2. Description of the Related Art

The cathode ray tube (CRT) has been the standard computer-display monitor for many years. Because CRTs have generally responded to analog display signals, there currently exists an extremely large installed base of computers (more than a billion) that incorporate digital-to-analog converters configured to generate CRT analog display signals.

Recently, digital display devices (e.g., flat-panel displays, liquid crystal displays, projectors, digital television displays and near-to-eye displays) have become increasingly popular. Although it is anticipated that all-digital interfaces will eventually become the standard interface for these displays, analog interfaces must be available for the near future because of the large existing installation base of computers.

Although the transmission and recovery of analog display signals can theoretically be error free, real display systems generally introduce errors into these processes. In addition, digital displays typically include image adjustments (e.g., brightness and contrast) which often misadjust analog interface parameters with the result that additional errors are introduced into the transmission and recovery processes. Because of these and other error sources, a disturbing number of display artifacts often appear in digital displays.

BRIEF SUMMARY OF THE INVENTION

Embodiments of the present invention provide structures and methods that reduce display artifacts in digital displays. The novel features of these embodiments are set forth with particularity in the appended claims. The invention will be best understood from the following description when read in conjunction with the accompanying drawings.

DETAILED DESCRIPTION OF THE INVENTION

FIGS. 1-8 illustrate display embodiments of the invention that reduce display artifacts in digital displays which are typically produced by errors in the transmission and recovery of analog display signals in digital display systems. This reduction is realized by the introduction of display redundancy and the subsequent use of this redundancy to provide intra-frame and inter-frame interleaving of different mapping processes which visually diffuses the display artifacts. Detailed descriptions of these embodiments are enhanced by preceding them with the following discussion of the basic structures of FIGS. 1 and 2.

Figure 1:
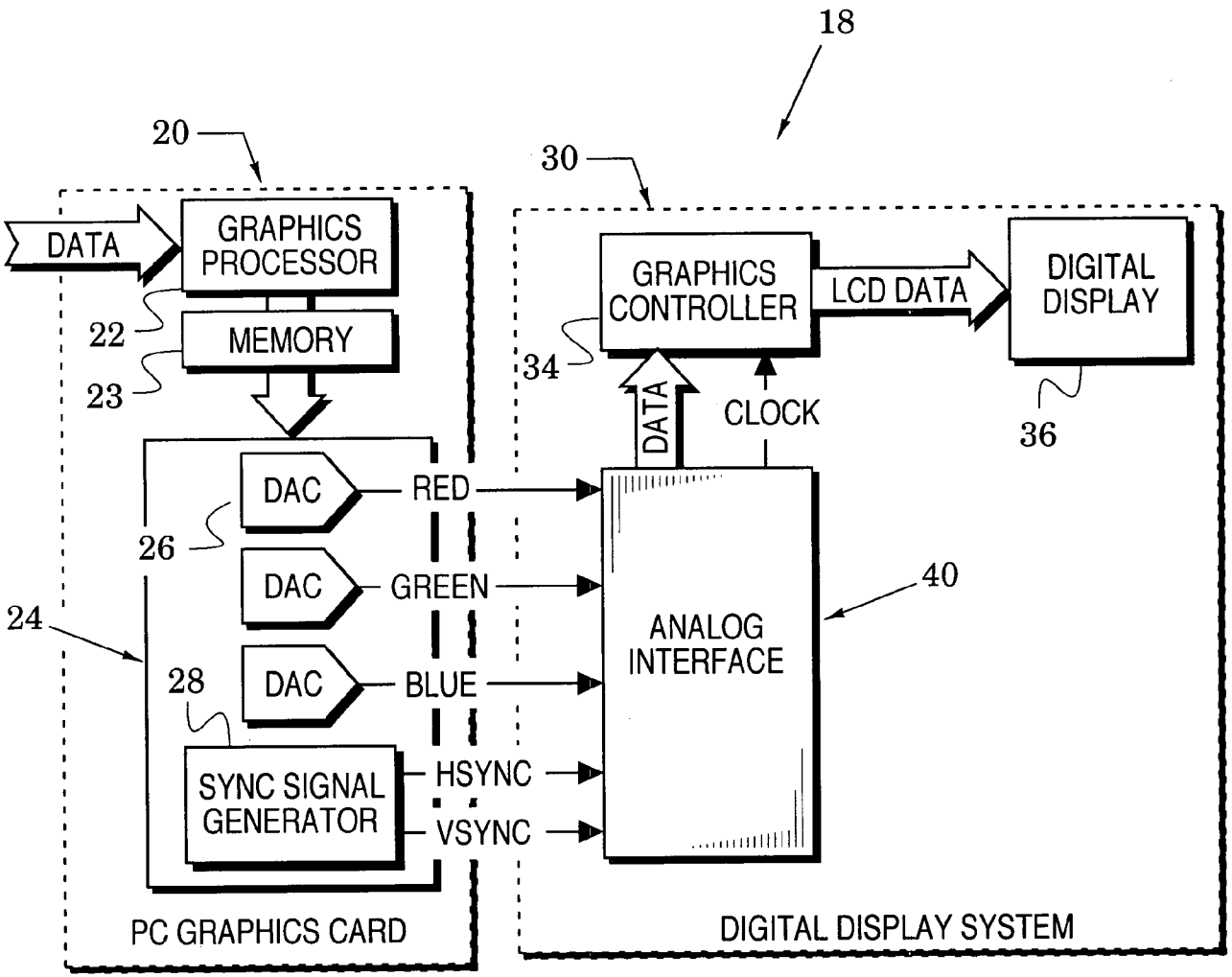
FIG. 1 is a block diagram of a display system embodiment of the present invention.

In particular, FIG. 1 illustrates a display system 18 which includes a graphics card 20 and a digital display system 30. The graphics card has a graphics processor 22, a memory 23 and a signal converter 24. The signal converter, in turn, comprises a set of digital-to-analog converters (DACs) 26 and a sync signal generator 28.

In operation of the graphics card 20, the graphics processor 22 renders data from a computer's central processing unit (not shown) into a graphics-oriented format (which may be stored in the memory 23). The DACs convert this formatted data into analog display signals that each contain analog information (coded, for example, in 256 analog levels) sufficient to generate one of the red, green and blue components that form an analog image (e.g., on a CRT).

The sync signal generator 28 also responds to the formatted data by generating synchronization signals that define spatial order for the analog display signals (i.e., the spatial order of display pixels). For example, these synchronization signals typically comprise a horizontal synchronization signal (hsync) that indicates the beginning of each display line and a vertical synchronization signal (vsync) that indicates the beginning of each frame of horizontal lines.

The digital display system 30 includes an analog interface 40, a graphics controller 34 and a digital display 36 which may be, for example, a liquid crystal display panel. In operation, the analog interface receives the red, green and blue analog display signals and their corresponding synchronization signals from the pc graphics card 20 and converts them to digital display signals and a corresponding clock signal. In particular, the graphics controller 34 receives these signals from the analog interface and formats them into forms suitable for display of the LCD data on the digital display 36.

Figure 2:
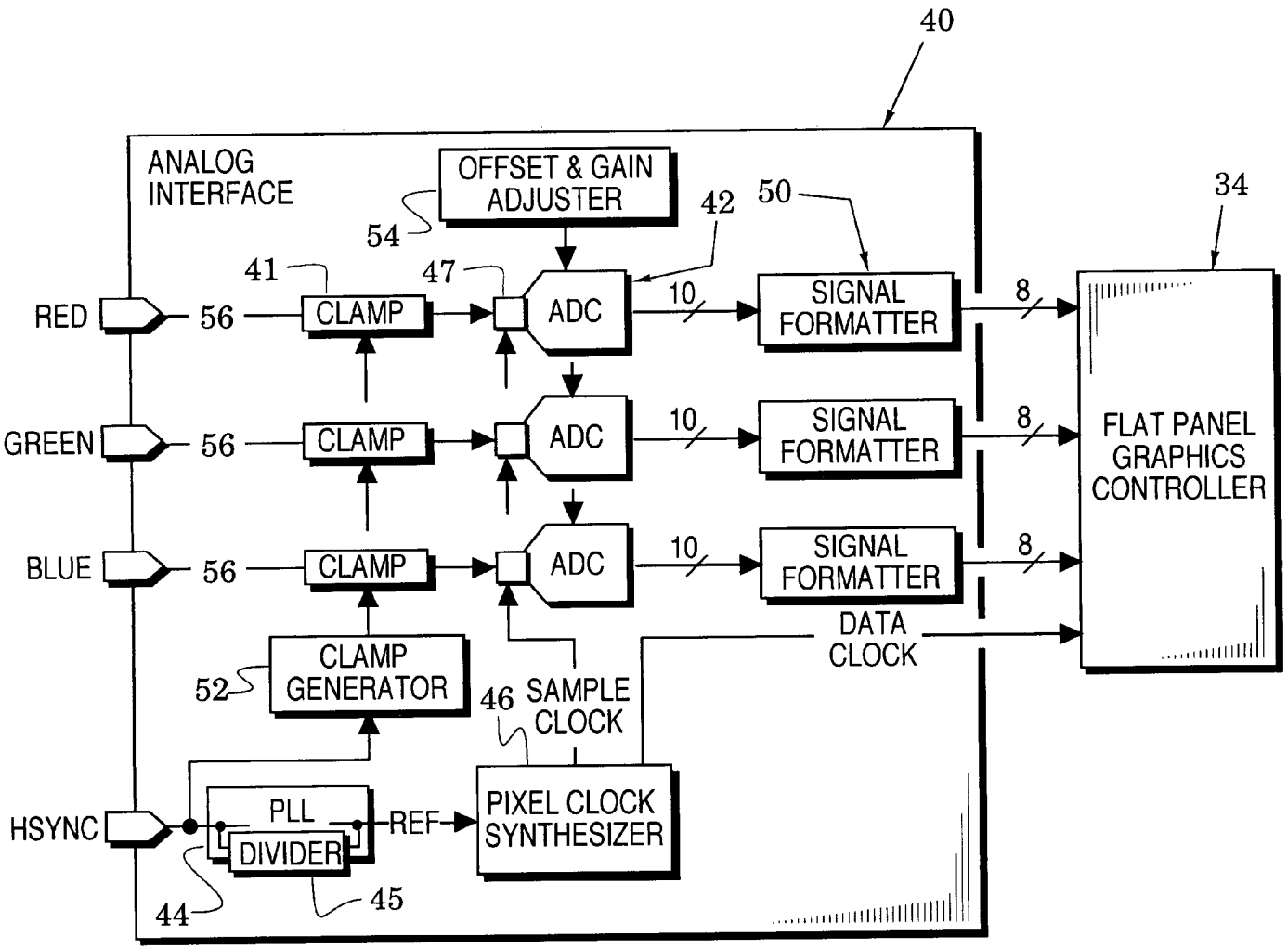
FIG. 2 is a block diagram of an analog interface embodiment in the system of FIG. 1.

In transit to the analog interface 40, the phase relationship between the synchronization signals and the red, green and blue analog display signals is typically lost and/or distorted and this relationship must be reconstructed in the analog interface. FIG. 2 illustrates an embodiment of the analog interface embodiment 40 which is particularly suited for the purpose of generating digital display signals that accurately recover this synchronization.

In particular, the analog interface 40 includes, for each of the red, green and blue analog display signals 56, an ADC 42 coupled between a clamp 41 and a signal formatter 50. It further includes a phase-locked loop (PLL) 44, a pixel clock synthesizer 46, and a clamp generator 52. The PLL 44 provides a reference signal (REF) which it phase locks to the hsync signal that comes from the sync signal generator (28 in FIG. 1).

It is intended that graphics will be displayed on the digital display (36 in FIG. 1) in a predetermined number of pixels (e.g., 1280) that are spaced across a predetermined number of display lines (e.g., 1024) that form one complete graphics frame (the VSYNC signal of FIG. 1 is not shown in other figures). Accordingly, the PLL includes a divider 45 that divides the reference signal so that it can be phase locked to the hsync signal. For example, if only the number of line pixels is considered and if the number is 1280, the divider 45 would be commanded to have a divisor of 1280 so that the ratio of the reference signal's frequency to the hsync signal's frequency would also be 1280.

In practice, each line generally includes a blanking signal which must also be considered. In at least one exemplary super extended graphics array (SXGA) display, the divisor would be increased to something on the order of 1350 to accommodate the blanking signal. In another example, the video electronics standard association (VESA) defines a "reduced blanking" timing which permits more active pixels to be transmitted to a digital display at a given pixel frequency.

The clock controller 49 monitors digital codes generated by at least one of the ADCs 42 and provides a frequency control signal to the divider 45 of the PLL 44 and a phase control signal to the pixel clock synthesizer 46. In response to the reference signal from the PLL, the pixel clock synthesizer 46 provides a sample clock which drives samplers 47 in each of the ADCs 42. In turn, the samplers provide analog samples of the analog display signals 56 and these samples are then quantized by the converter portions of the ADCs 42. The ADCs may be formed, for example, by a single converter stage or by a plurality of pipelined converter stages.

In order to set the black level of the ADCs properly, the clamp generator provides information as to the location of the "back porch" which is located between each hsync signal and the first pixel of the line. At this point, the clamp generator 52 commands the clamps 41 to establish a predetermined clamp level (e.g., 0 volts) for each ADC. The offset and gain adjuster 54 can be used in a conventional manner to set the offset and gain of each ADC which essentially sets the brightness and contrast of the red, green and blue pixels on the digital display (36 in FIG. 1).

Directing attention now to display embodiments that reduce display artifacts in digital displays, it is initially noted that transmission and recovery of the analog display signals (56 in FIG. 2) is generally degraded by various process errors such as misadjustment of analog interface parameters (e.g., the brightness and contrast parameters associated with the offset and gain adjuster 54). These process errors manifest themselves by artifacts that appear on the digital display (36 in FIG. 1) and significantly degrade the display appearance.

Embodiments of the present invention recognize that these display artifacts can be substantially reduced by first quantizing each of the analog display signals 56 of FIG. 2 to provide redundancy in an M-bit digital display signal and then reducing this redundant signal to an N-bit digital display signal with different digital mapping rules for different sets of display lines.

Figure 3:
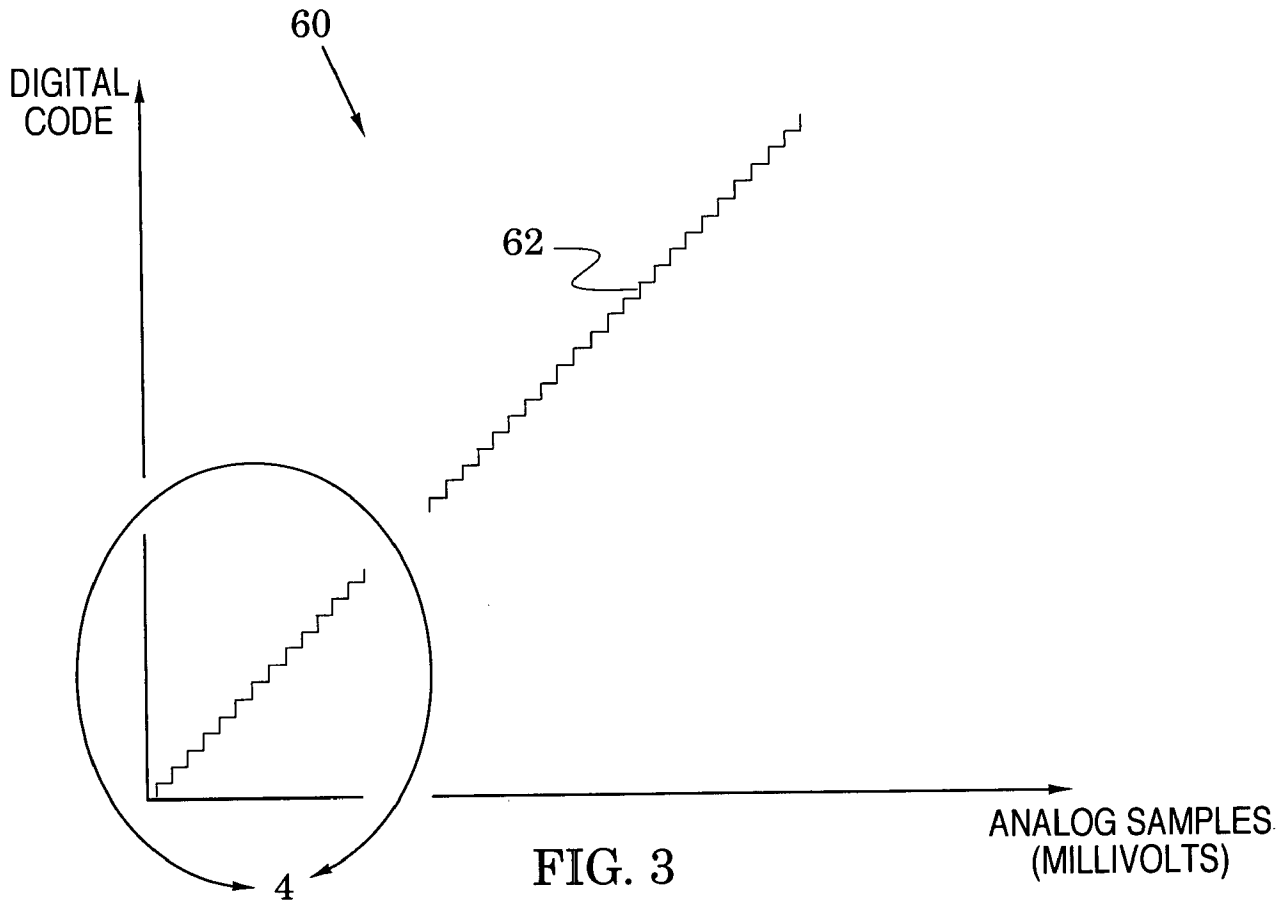
FIG. 3 is a graph which illustrates a transfer function of an analog-to-digital converter in the analog interface of FIG. 2.
Figure 4A:
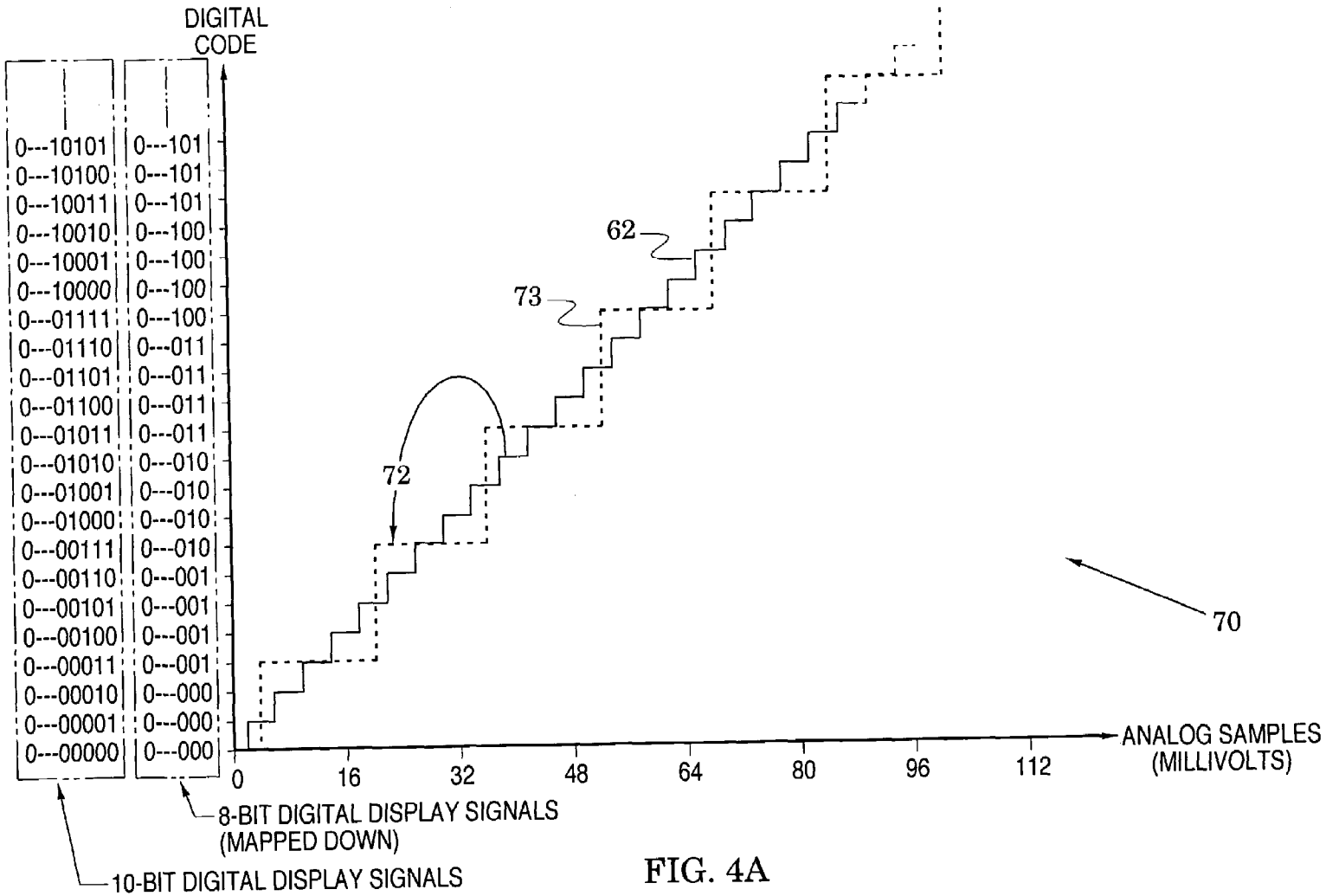
FIGS. 4A and 4B are enlarged views of the area 4 in the graph of FIG. 3, the views illustrating first and second mapping rule embodiments in a signal formatter in the analog interface of FIG. 2.
Figure 4B:
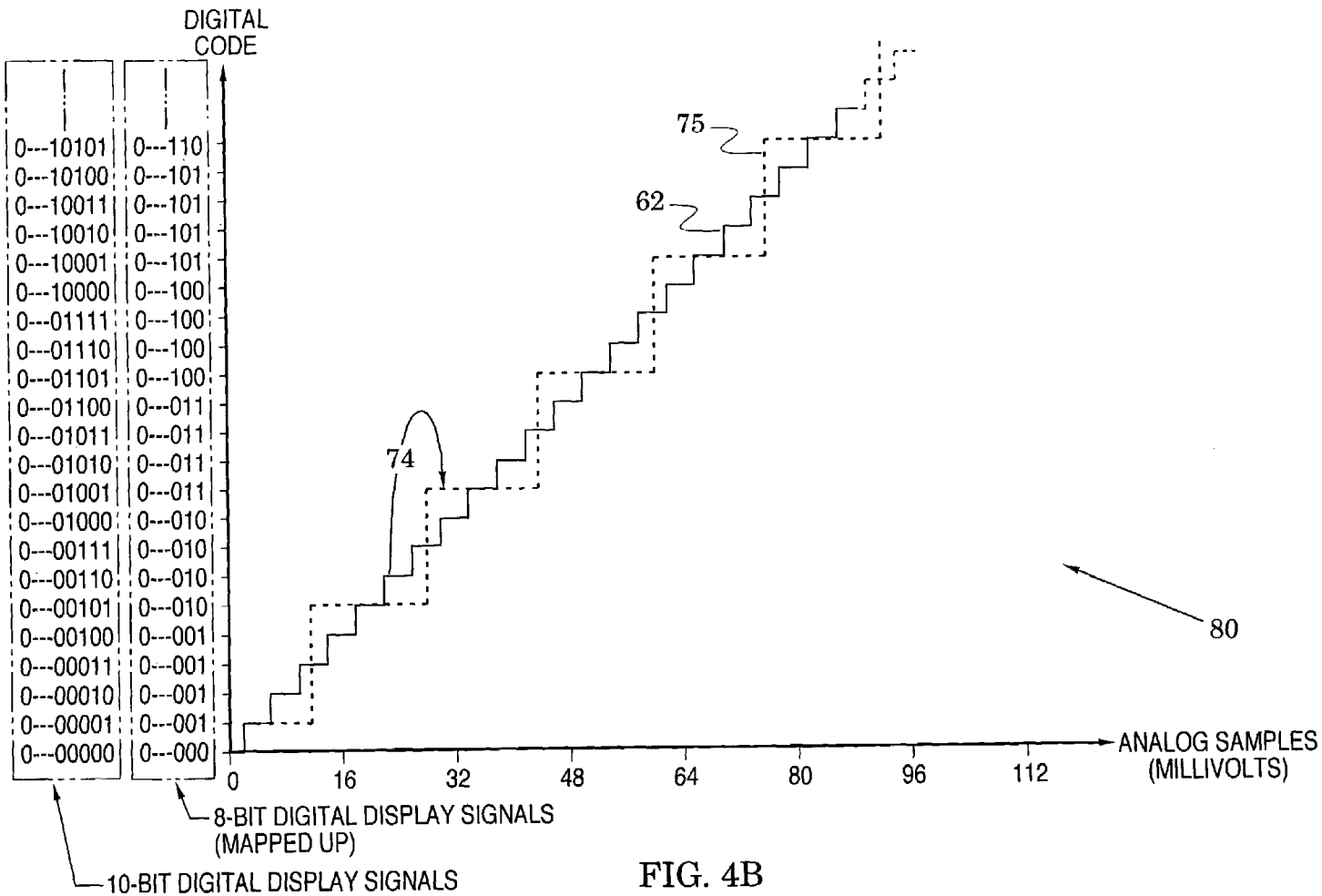

These formatting processes are initially exemplified in the graphs 60, 70 and 80 of FIGS. 3, 4A and 4B. Graph 60 shows a stepped plot that indicates a portion of the transfer function 62 of each of the ADCs 42 of FIG. 2. A lowest portion of the transfer function 62 is encircled by a curved line 4 and this portion is greatly enlarged in the graphs 70 and 80 of FIGS. 4A and 4B.

The transfer function 62 relates regions of the analog samples (provided by the samplers 47 of FIG. 2) to their corresponding digital codes as provided by the ADCs. In FIGS. 4A and 4B, the analog regions are shown with exemplary millivolt values along the horizontal axis of the graph 60 and the digital codes are shown along the vertical axis. Although M and N can be configured as various numbers, it is assumed in FIGS. 4A and 4B (for descriptive purposes) that M is ten and N is eight. A portion of the 10-bit digital display signals (generated by one of the ADCs 42 of FIG. 2) is shown at the extreme left side of FIG. 4A.

Although embodiments of the invention include any first and second mapping rules that differ from each other, the graph 70 shows an exemplary first mapping rule which maps down the 10-bit digital display signals to obtain the corresponding mapped-down 8-bit digital display signals that are shown immediately adjacent to the 10-bit digital display signals. For example, the mapping arrow 72 indicates that the 10-bit digital word ending in 01010 is mapped down to the 8-bit digital word ending in 010. This first mapping rule realizes the transfer function shown in FIG. 4A by the broken line 73.

The graph 80 of FIG. 4B shows an exemplary second mapping rule which maps up the 10-bit digital display signals to obtain the corresponding mapped-up 8-bit digital display signals that are shown immediately adjacent to the 10-bit digital display signals. For example, the mapping arrow 74 indicates that the 10-bit digital word ending in 00110 is mapped to the 8-bit digital word ending in 011. This second mapping rule realizes the transfer function shown in FIG. 4B by the broken line 75.

The first and second mapping rules illustrated in FIGS. 4A and 4B provide different mappings that can be utilized by the signal formatters (50 in FIG. 2) as they reduce the redundancy of M-bit digital display signals to the N-bit digital display signals. These exemplary mapping rules are shown with other mapping rule embodiments in the table 90 of FIG. 5. The table has an "input" column which indicates a lower portion of the ten bit words entering the signal formatters (50 in FIG. 2). These words are for illustrative purposes and thus terminate with the digital word ending in 01111 (for simplicity, only the 5 least significant bits are shown for each word.

Columns titled "mapped down" and "mapped up" list the mapped words that correspond to the mappings shown in graphs 70 and 80 of FIGS. 4A and 4B. A third mapping rule is titled "truncated" and realizes 8-bit digital words by discarding (i.e., truncating) the two least significant bits of each 10-bit digital word. A fourth mapping rule is titled "rounded" and realizes the 8-bit digital words by rounding each 10-bit digital word to the nearest 8-bit digital word.

Figures 5, 8:
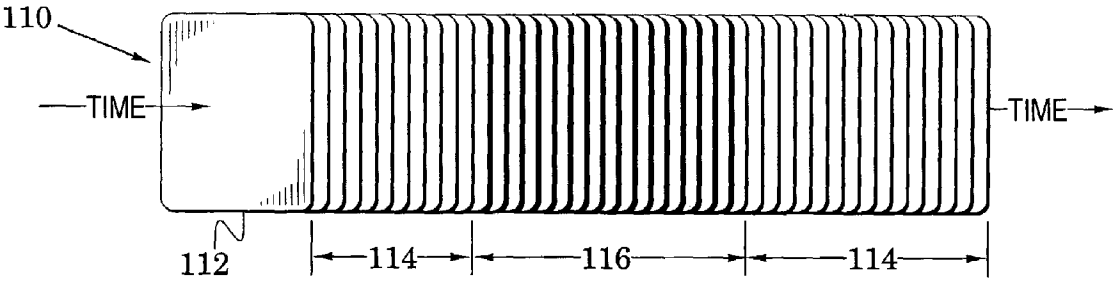
FIG. 5 is a table of mapping rule embodiments for use in the signal formatter in the analog interface of FIG. 2.
FIG. 8 is a temporal view of display frames provided by the signal formatter in the analog interface of FIG. 2.

It is noted that the mapping rules of FIG. 5 can be realized by simple processing of the 10-bit digital display signals in the signal formatters 50 of FIG. 2. "Truncated", for example, can be realized with the processes of, a) adding 0-00000 to the 10-bit digital display signals, and b) truncating the sum to 8.

"Mapped down", "rounded" and "mapped up" rules can be realized with the same processes except that 0-00001, 0-00010 and 0-00011 are respectively substituted for 0-00000 in the adding process. Other mapping rules of the invention may be realized by truncating the M-bit digital display signals to truncated digital display signals and altering at least one bit in selected digital words of the truncated digital display signal. The signal formatters (50 in FIG. 2) can be configured with various conventional elements (e.g., an array of gates, an appropriately-programmed digital processor or combinations thereof) to realize these various mapping rules.

Figure 7B:
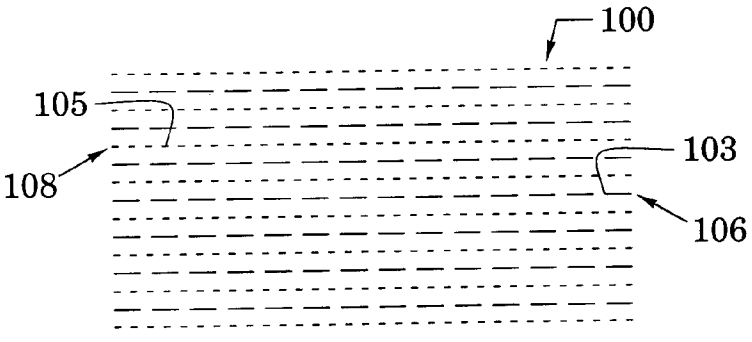
FIGS. 7A and 7B are enlarged views of an area 100 in the display of FIG. 6 which illustrate interleaving embodiments associated with the mapping rules of FIGS. 4A, 4B and 5.
Figure 7A:
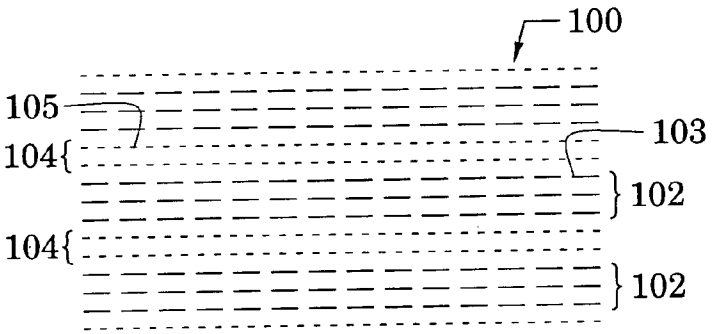
Figure 6:
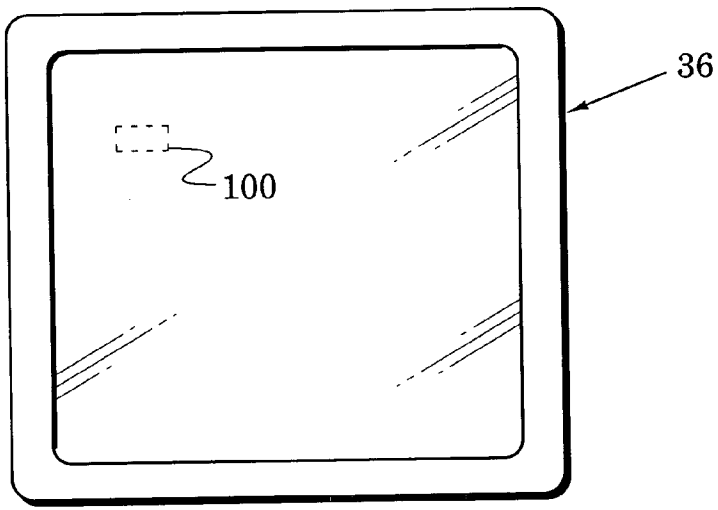
FIG. 6 is a front view of a digital display in the system of FIG. 1.

The exemplary mapping rules introduced in FIGS. 4A, 4B and 5 can be used to reduce display artifacts on the digital display 36 of FIG. 1 which is shown in a front view in FIG. 6. FIGS. 7A and 7B greatly enlarge an area 100 on the display 36 to show a group of individual display lines that are indicated by broken horizontal lines. FIG. 7A has first sets 102 of display lines 103 which are shown by one style of broken line and has second sets 104 of display lines 105 which are shown by a different style of broken line. In FIG. 7A, each set includes 3 display lines. The sets have been reduced in FIG. 7B to sets 106 and 108 that respectively comprise single lines 103 and 105.

In an exemplary mapping embodiment, the mapping rule "truncated" (illustrated in FIG. 5) can be used in the first sets 102 and the mapping rule "mapped up" (also illustrated in FIG. 5) can be used to map the M-bit digital display signal to the N-bit digital display signal in the interleaved second sets 104. It has been found that this interleaving of different mapping processes visually diffuses the display artifacts that are typically produced by errors in the transmission and recovery of analog display signals in digital display systems. It is known that the human eye is particularly sensitive to patterns generated by display artifacts. Introducing a controlled amount of noise into these patterns blurs or smears them so that they are less likely to be noticed. The introduced noise needs to be sufficient to mask the artifacts but not large enough to be evident and disturbing.

The method and structural embodiments of the invention facilitate the controlled introduction of noise in manners that can be selectively altered to realize enhanced artifact reduction. For example, boxes 92 have been introduced into FIG. 5 to show adjacent mappings that map to the same 8-bit word. These boxes indicate that the mappings of "truncated" and "mapped down" probably differ less from each other than do the mappings of "truncated" and "mapped up". Choices of these mappings can be combined with choices of the size of the mapping sets of FIGS. 7A and 7B to find combinations that best reduce display artifacts.

Because the number of lines in each set of lines can be selected and the difference between the mappings of these sets can also be selected, the method embodiments of the invention provide considerable latitude for reducing display artifacts. These method embodiments include the processes of:

a) interleaving first and second sets of first and second display lines, b) in the first sets, mapping the M-bit digital display signal to the N-bit digital display signal with a first mapping rule; and c) in the second sets, mapping the M-bit digital display signal to the N-bit digital display signal with a different second mapping rule.

The diagram 110 of FIG. 8 illustrates successive digital display frames 112. The frames have been shown with different line weights to show that one selection of mappings and set sizes may be used over time durations 114 and a different selection of mappings and set sizes used in a time duration 116 that is temporally interleaved with the durations 114. FIG. 8 demonstrates that the first and second mapping rules can be temporally altered. It has been found that this additional process further enhances the ability to reduce display artifacts. Method embodiments of the invention thus provide intra-frame mapping choices and inter-frame alterations of these choices.

The advantages of the invention are realized with redundancy that is introduced by increasing the resolution of the ADCs of the display system of FIG. 1. Because all other system elements can be configured at a lower resolution, the visual advantageous of embodiments of the invention can be realized with relatively low cost. In addition, the mapping patterns (inter-frame and intra-frame) can be precisely controlled because method embodiments of the invention are realized in the digital domain.

For illustrative purposes, FIGS. 7A and 7B illustrate first and second sets that respectively have three display lines and one display line. However, other set embodiments may include any number of display lines, the numbers may temporally change, and the number in a first set may differ from a number in a second set. The teachings of the invention may be have been illustrated with M-bit ADCs and N-bit digital displays in which M exceeds N by two but, in general, it is sufficient that M exceeds N.

The embodiments of the invention described herein are exemplary and numerous modifications, variations and rearrangements can be readily envisioned to achieve substantially equivalent results, all of which are intended to be embraced within the spirit and scope of the invention as defined in the appended claims.

I claim:

1. A method of diffusing display artifacts on in a digital display generated by an N-bit display signal, comprising the steps of:

providing an M-bit digital display signal wherein M exceeds N to thereby provide redundancy; and reducing said M-bit digital display signal to an N-bit digital display signal by;

a) interleaving first and second sets of respective first and second display lines, b) in all pixels of said first sets, mapping said M-bit digital display signal to said N-bit digital display signal with a redundancy-reducing first mapping rule; and c) in all pixels of said second sets, mapping said M-bit digital display signal to said N-bit digital display signal with a different redundancy-reducing second mapping rule;

interleaving of different redundancy-reducing mapping rules thereby visually diffusing said display artifacts.

2. The method of claim 1, further including the step of selecting said first and second mapping rules from a mapping set that includes the rules of truncating, mapping down, rounding, and mapping up digital words of said M-bit digital display signal.

3. The method of claim 1, wherein at least one of said mapping rules includes the steps of:

truncating said M-bit digital display signal to a truncated digital display signal; and altering at least one bit in selected digital words of said truncated digital display signal.

4. The method of claim 1, wherein said first and second sets comprise single display lines.

5. The method of claim 1, wherein at least one of said first and second sets comprise multiple display lines.

6. The method of claim 1, wherein M exceeds N by at least two.

7. The method of claim 1, further including the step of temporally changing at least one of said first and second mapping rules.

8. The method of claim 1, further including the step of changing at least one of said first and second mapping rules for selected digital display frames.

9. The method of claim 1, wherein said providing step includes the step of quantizing an analog display signal to provide said M-bit digital display signal.

10. An analog interface which receives an analog display signal and generates an N-bit digital display signal that provides diffused display artifacts, comprising:

at least one analog-to-digital converter that includes:

a) a sampler that extracts analog samples from said analog display signal; and b) at least one converter stage that quantizes said analog samples into an M-bit digital display signal wherein M exceeds N to thereby provide redundancy; and a signal formatter that reduces said M-bit digital display signal to an said N-bit digital display signal wherein said signal formatter:

a) interleaves first and second sets of respective first and second display lines, b) in all pixels of said first sets, maps said M-bit digital display signal to said N-bit digital display signal with a redundancy-reducing first mapping rule; and c) in all pixels of said second sets, maps said M-bit digital display signal to said N-bit digital display signal with a different redundancy-reducing second mapping rule;

interleaving of different redundancy-reducing mapping rules thereby visually diffusing said display artifacts.

11. The interface of claim 10, wherein at least one of said mapping rules is selected from a mapping set that includes the rules of truncating, mapping down, rounding, and mapping up digital words of said M-bit digital display signal.

12. The interface of claim 10, wherein at least one of said mapping rules truncates said M-bit digital display signal to a truncated digital display signal and alters at least one bit in selected digital words of said truncated digital display signal.

13. The interface of claim 10, wherein said first and second sets comprise single display lines.

14. The interface of claim 10, wherein at least one of said first and second sets comprise multiple display lines.

15. The interface of claim 10, wherein M exceeds N by at least two.

16. The interface of claim 10, wherein said signal formatter is configured to temporally change at least one of said first and second mapping rules.

17. The interface of claim 10, wherein said signal formatter is configured to change at least one of said first and second mapping rules for selected digital display frames.

18. The interface of claim 10, further including:

a phase-locked loop that locks a reference signal to a multiple of a synchronization signal associated with said analog display signal; and a clock synthesizer that introduces a phase shift to said reference signal to thereby provide a sample clock to said analog-to-digital converter.

19. A display system which generates a visual display with diffused display artifacts with an N-bit digital display signal, the system comprising:

at least one analog-to-digital converter that includes:

a) a sampler that extracts analog samples from an analog display signal; and b) at least one converter stage that quantizes said analog samples into an M-bit digital display signal wherein M exceeds N to thereby provide redundancy;

a signal formatter that reduces said M-bit digital display signal to said N-bit digital display signal wherein said signal formatter:

a) interleaves first and second sets of respective first and second display lines, b) in all pixels of said first sets, maps said M-bit digital display signal to said N-bit digital display signal with a redundancy-reducing first mapping rule; and c) in all pixels of said second sets, maps said M-bit digital display signal to said N-bit digital display signal with a different redundancy-reducing second mapping rule; and a digital display that provides said visual display in response to said N-bit digital display signal;

interleaving of different redundancy-reducing mapping rules thereby visually diffusing said display artifacts.

20. The system of claim 19, wherein at least one of said mapping rules is selected from a mapping set that includes the rules of truncating, mapping down, rounding, and mapping up digital words of said M-bit digital display signal.

21. The system of claim 19, wherein at least one of said mapping rules truncates said M-bit digital display signal to a truncated digital display signal and alters at least one bit in selected digital words of said truncated digital display signal.

22. The system of claim 19, wherein said first and second sets comprise single display lines.

23. The system of claim 19, wherein at least one of said first and second sets comprise multiple display lines.

24. The system of claim 19, wherein M exceeds N by at least two.

* * * * *